US007286146B2

(12) United States Patent
Goldschmidt et al.

(10) Patent No.: US 7,286,146 B2
(45) Date of Patent: Oct. 23, 2007

(54) METHOD AND SYSTEM FOR LED TEMPORAL DITHERING TO ACHIEVE MULTI-BIT COLOR RESOLUTION

(75) Inventors: Alan B. Goldschmidt, Lake Forest, CA (US); Alexander N. Artsyukhovich, Irvine, CA (US)

(73) Assignee: Alcon, Inc., Hunenberg (CH)

( * ) Notice: Subject to any disclaimer, the term of this patent is extended or adjusted under 35 U.S.C. 154(b) by 621 days.

(21) Appl. No.: 10/734,664

(22) Filed: Dec. 12, 2003

(65) Prior Publication Data

US 2005/0110808 A1 May 26, 2005

Related U.S. Application Data

(60) Provisional application No. 60/524,966, filed on Nov. 25, 2003.

(51) Int. Cl.
*G09G 5/10* (2006.01)

(52) U.S. Cl. ..... 345/690; 345/83; 345/596

(58) Field of Classification Search ..... 345/611, 345/690, 89, 596–600, 82, 83
See application file for complete search history.

(56) References Cited

U.S. PATENT DOCUMENTS 5,266,908 A * 11/1993 Koulopoulos et al. ..... 331/2
5,459,486 A * 10/1995 Iverson et al. ..... 345/593
7,071,908 B2 * 7/2006 Guttag et al. ..... 345/87
2002/0145619 A1 * 10/2002 Hoppenbrouwers et al. ..... 345/690
2003/0103058 A1 * 6/2003 Hellen Brown Elliott et al. ..... 345/589
2005/0129273 A1 * 6/2005 Pryor ..... 382/103

OTHER PUBLICATIONS

Mulligan, Improving Digital Halftones by Exploiting Visual System Properties, Conference Record, 27th Asilomar Conference on Signals, Systems and Computers, 1993, pp. 961-965, IEEE Computer Society Press, A Singh (Ed.).

* cited by examiner

*Primary Examiner*—Ricardo Osorio
(74) *Attorney, Agent, or Firm*—Armando Pastrana, Jr.

(57) ABSTRACT

A method and system for temporal dithering of an LED indicator are disclosed, one embodiment of the method comprising: initializing the LED indicator to display a first color of a color palette; during each cycle of a preset cycling rate, cycling the LED indicator display color between the first color and one or more selected colors of the color palette, wherein the LED indicator is caused to display in turn the first color and each selected color of the color palette for a preset portion of each cycle determined to result in a perceived display color at the LED indicator; and repeating the cycling step to maintain the perceived display color at the LED indicator. The method can further comprise the step of changing the perceived display color to a new perceived display color. Changing the perceived display color can comprise: adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator. Further, changing the perceived display color can be manually initiated or automatically initiated in response to a changing condition. The changing condition can be, for example, an exceeded limit of a parameter associated with the LED indicator.

52 Claims, 4 Drawing Sheets

10
12
55
U1655
AND5
Adder
256 RESET
50
U1661
MCOMP
A0
A1
A2
A3
A4
A5
A6
A7
B0
B1
B2
B3
B4
B5
B6
B7
AEB0
AEB1
AEB2
AEB3
AEB4
AEB5
AEB6
AEB7
ALT8
AEO8
AGT8
COMPARATOR
TO
LED
14
LATCH
57
CNT0
CNT1
CNT2
CNT3
CNT4
CNT5
CNT6
CNT7
XX0
XX1
XX2
XX3
XX4
XX5
XX6
XX7
FROM
COUNTERS
20 & 22
20
U1651
74153
OA
OB
OC
OD
RCO
A
B
C
D
ENP
ENT
CLK
LDN
CLRN
U1657
74163
450KPULS
3P8MHZ
VCCO
PORAT
TEMPORAL
DITHERING
LOGIC Fig. 3
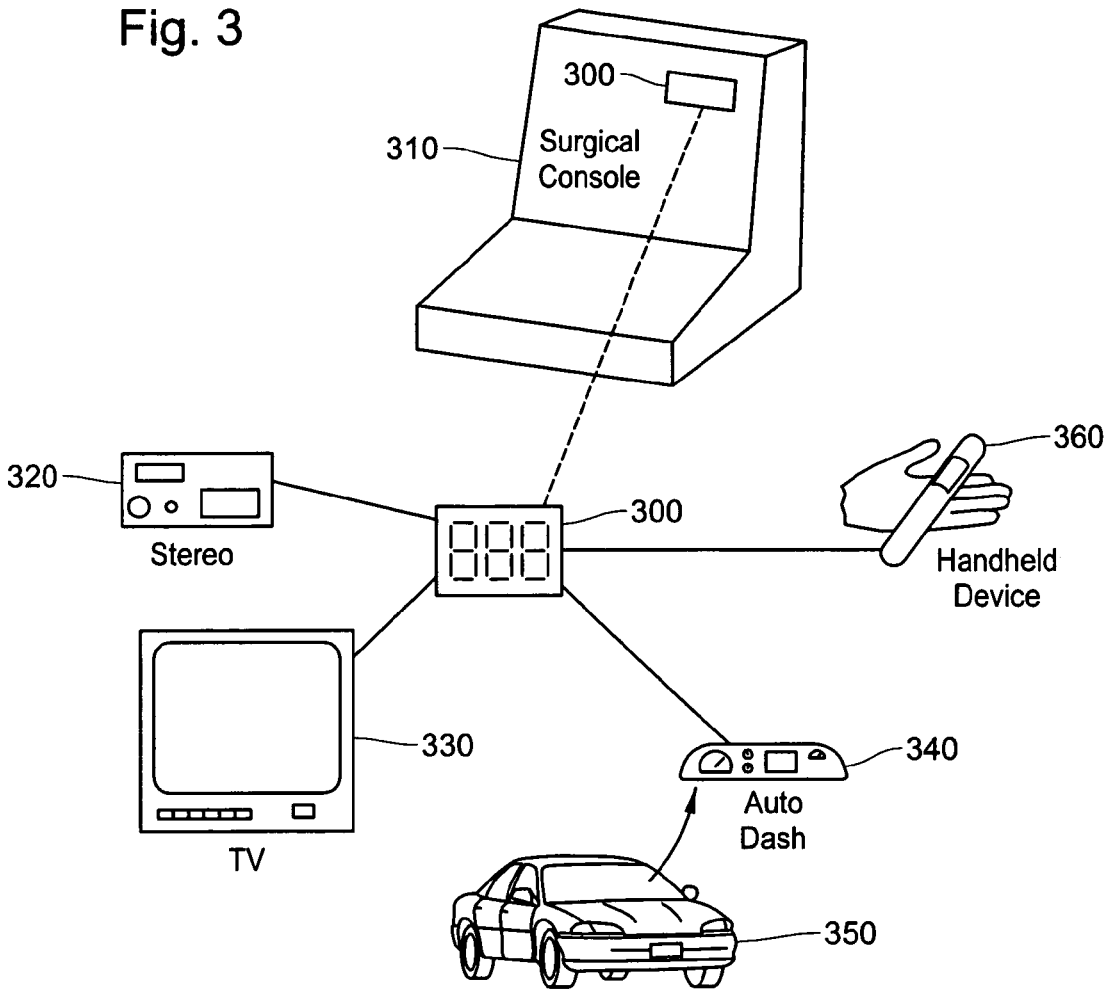
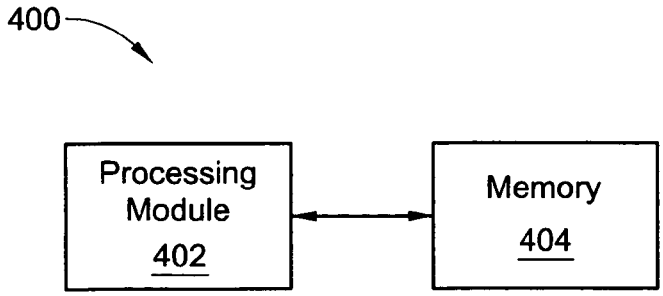
Fig. 4

METHOD AND SYSTEM FOR LED TEMPORAL DITHERING TO ACHIEVE MULTI-BIT COLOR RESOLUTION

TECHNICAL FIELD OF THE INVENTION

This application claims priority from U.S. Ser. No. 60/524,966 filed Nov. 25, 2003.

The present invention relates generally to the field of visual indicators and warning devices. In particular, the present invention relates to visual indicators for use in surgical devices. Even more particularly, the present invention relates to the temporal dithering of Light Emitting Diode ("LED") indicators for achieving multi-bit color resolution LED displays.

BACKGROUND OF THE INVENTION

Light Emitting Diodes ("LEDs") are commonly used as indicators in a variety of applications, ranging from consumer electronics (e.g., stereo status displays, power on/off indicators, etc.) to commercial applications such as in manufacturing control consoles, avionics, and surgical systems. However, commonly available LEDs, as known to those familiar with the art, are typically either single color, bi-color (two-bit color), or, more recently, tri-color (three-bit color) LEDs. Further, within these limited choices the colors themselves are limited to either red/green bi-color LEDs or red, green, and blue tri-color LEDs. The range of possible indications from the same LED and the ability to transmit information to a viewer through a multi-color display is thus limited by current LED technology.

Methods do exist for obtaining multi-color displays from either monochromatic display devices or from display devices with limited colors. Some methods have been applied to multi-color displays as well for achieving crisper displays. For example, temporal dithering has been used in Cathode Ray Tube ("CRT") and Liquid Crystal Display ("LCD") devices to improve half-toning and color resolution. This process of representing continuous tone images on, for example, a binary display device is known as "half-toning" or "dithering."

Dithering works because the human visual system integrates information over spatial regions, so that a spatial pattern of light and dark can invoke a sensation approximating that of a uniform color area even when the individual display elements cannot be resolved. Temporal dithering is especially useful in the case of dynamically controllable displays such as CRTs and flat panel displays. Temporal dithering refers to the rendition of a desired gray level with a spatial distribution of flickering pixels. The response of the human visual system to color is markedly different than its response to chromatic or luminance information. For the purposes of dithering, the important facts are that the human chromatic sub-system is low pass both in space and time. For example, if a pattern of colored stripes is progressively minified, at some point the colors of the individual stripes will blend and the pattern will appear to have variations only of intensity. Further, the pattern will be completely invisible if the colors are made equally illuminate (equal visual intensities).

Additional benefits may be reaped from the temporal low pass character of the chromatic system. When two colored lights are exchanged or flickered, the color will appear to alternate at low flicker rates, but when the frequency is raised to 15-20 kHz, color-flicker fusion occurs, where a single steady color is seen and the flicker is seen as a variation of intensity only. It is possible to eliminate all sensation of flicker by balancing the intensity of the two lights (colors) making them equally illuminate. When the intensities are not balanced, the luminance flicker can be seen at frequencies as high as 50-60 kHz.

While it is desirable to have multi-color capable indicators for rapid and accurate transmission of information from an electronic system to an operator, the limitations of currently existing LED technology are such that only a limited number of colors can be usably achieved. Further, these existing displays are limited in that the color of each LED in a display cannot be changed beyond the current state of the art of three colors per LED (e.g., when using tri-color LEDs). Therefore, while it is desirable to have more than three colors available for display within the same or multiple LED indicators, it is not feasible using the currently available LED technology.

Therefore, a need exists for a method and system for temporal dithering of LED indicators to achieve multi-bit color resolution indicators that can reduce or eliminate the problems of limited display colors, non-chromatically adjustable displays, and other problems associated with prior art LED indicators.

BRIEF SUMMARY OF THE INVENTION

The embodiments of the method and system for temporal dithering of LED indicators to achieve multi-bit color resolution displays of the present invention substantially meet these needs and others. One embodiment of the method for temporal dithering of an LED indicator of this invention comprises: initializing the LED indicator to display a first color of a color palette; during each cycle of a preset cycling rate, cycling the LED indicator display color between the first color and one or more selected colors of the color palette, wherein the LED indicator is caused to display in turn the first color and each selected color of the color palette for a preset portion of each cycle determined to result in a perceived display color at the LED indicator; and repeating the cycling step to maintain the perceived display color at the LED indicator.

The method can further comprise the step of changing the perceived display color to a new perceived display color. Changing the perceived display color can comprise: adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator. Further, changing the perceived display color can be manually initiated or automatically initiated in response to a changing condition. The changing condition can be, for example, an exceeded limit of a parameter associated with the LED indicator.

The LED indicator can be, for example, a bi-color LED indicator, with a corresponding color palette comprising a red color and a green color, or a tri-color LED indicator with a corresponding color palette comprising a red color, a green color and a blue color. Each cycle of the preset cycling rate can comprise a number of equal discrete time periods set by selection of a counter, wherein the number of equal discrete time periods is equal to the range of the counter. Further, each preset portion of each cycle during which the first color and each of the one or more selected colors is displayed can comprise one or more of the equal discrete time periods. The size of the preset portion for each of the first color and the one or more selected colors is set to result in a desired perceived display color at the LED indicator. The perceived display color is the blended sum of the first and the one or more selected colors displayed at the LED indicator as perceived by a human observer.

Other embodiments of the present invention can include a system and an apparatus for temporal dithering of an LED indicator to achieve multi-bit color resolution displays in accordance with the teachings of this invention. Further, embodiments of this invention can be incorporated within another device, such as a surgical machine or system for use in ophthalmic or other surgery. Other uses for a system and method for temporal dithering of LED indicators to achieve a multi-bit color resolution display will be known to those familiar with the art. Although the present invention is described herein with reference to LED indicators in a surgical system, it is contemplated that the teachings of this invention are equally applicable to, and can be implemented in, any system or device requiring multi-color indicators.

One embodiment of the system for temporal dithering of an indicator of this invention comprises: an LED indicator operable to display a light color; a temporal dithering logic operable to drive the LED; and an algorithm operable to control the temporal dithering logic and cause the LED indicator to sequentially display one or more light colors from a color palette associated with the LED indicator in a pattern determined to result in a perceived display color at the LED indicator. The algorithm can comprise computer-executable software instructions operable to control the temporal dithering logic. The temporal dithering logic can comprise: a counter, operable to produce a counter output signal; a multiplexer, operable to produce a multiplexer output signal for selecting from the color palette the light color displayed at the LED indicator; an adder operable to receive the counter output signal and to reset the counter when the counter output signal reaches a maximum value; and a comparator operable to: receive and compare the counter output signal and the multiplexer output signal; provide a driving signal to the LED indicator to cause the LED indicator to display the selected light color as determined by the multiplexer output signal; and, if the counter output signal and the multiplexer output signal are of equal value, produce a latch signal to cause the driving signal value to change to select a next light color from the color palette for display at the LED indicator.

BRIEF DESCRIPTION OF THE SEVERAL VIEWS OF THE DRAWINGS

A more complete understanding of the present invention and the advantages thereof may be acquired by referring to the following description, taken in conjunction with the accompanying drawings, in which like reference numbers indicate like features and wherein:

FIG. 3 is a simplified block diagram showing various possible implementations for embodiments of the method and system of this invention; and FIG. 4 is a simplified block diagram of an apparatus for temporal dithering of an LED indicator in accordance with the teachings of this invention.

DETAILED DESCRIPTION OF THE INVENTION

Preferred embodiments of the present invention are illustrated in the FIGUREs, like numerals being used to refer to like and corresponding parts of the various drawings.

The various embodiments of the present invention provide for temporal dithering of an LED indicator to achieve a multi-bit color resolution display. Sequential altering of the colors, in, for example, a bi-color or a tri-color LED, at a sufficiently high rate (e.g., greater than 60 kHz) creates a visual perception of a desired color in human vision (different colors being achieved at different frequencies). The method of this invention is in contrast to intensity half-toning, in which all colors are lit simultaneously, but with different intensity amplitudes. Cycling between, for example, the red, green, and blue colors of a tri-color LED (Light Emitting Diode) indicator, at different frequencies can create any visible color tone within the color gamut achievable at the intensities of the LED. Multi-bit color displays can thus be achieved by cycling, at a frequency corresponding to the desired color, between the colors of, for example, a bi-color or tri-color LED. The available colors will fall in the color spectrum between the colors of the cycled LED. For example, by cycling between the colors of a red/green bi-color LED, the same LED can be made to yield multiple color tones of red, orange, yellow and green. In this way, color displays in a plurality of colors can be achieved from a bi-color LED.

Embodiments of the method and system for temporal dithering of LED indicators of this invention can be implemented in any device requiring a color display, and, in particular, multiple different and perhaps variable color displays for indicating and distinguishing between parameters. For example, multi-color LED displays in accordance with the teachings of this invention can be implemented for use in a surgical machine within the general field of ophthalmic surgery. Further, multi-bit color displays can be made in accordance with this invention for use in consumer products, such as stereo and television displays, automotive dashboards for indicating various performance parameters, surgical machines or handheld instruments requiring a display, or any other such application where multi-color LED indicators are desirable. Although the present invention will be described with reference to surgical devices and consumer devices, it is contemplated and it will be realized by those skilled in the art that the scope of the present invention is not limited to these applications, but may be applied generally to any other application in which multi-color LED indicators are desirable.

Figure 1A:
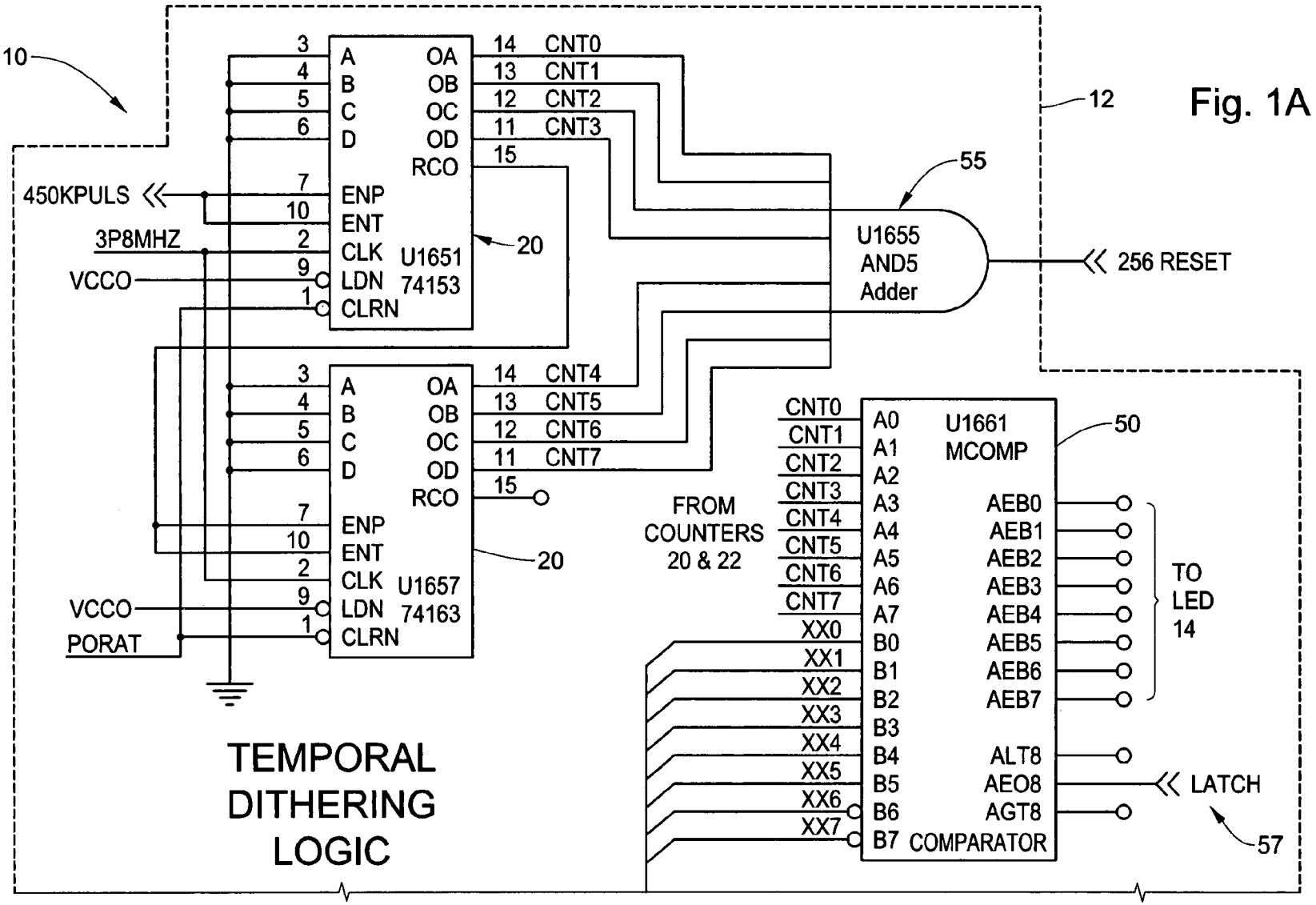
FIG. 1 is a schematic block diagram of an exemplary embodiment of the system for temporal dithering of an LED indicator of this invention.
Figure 1B:
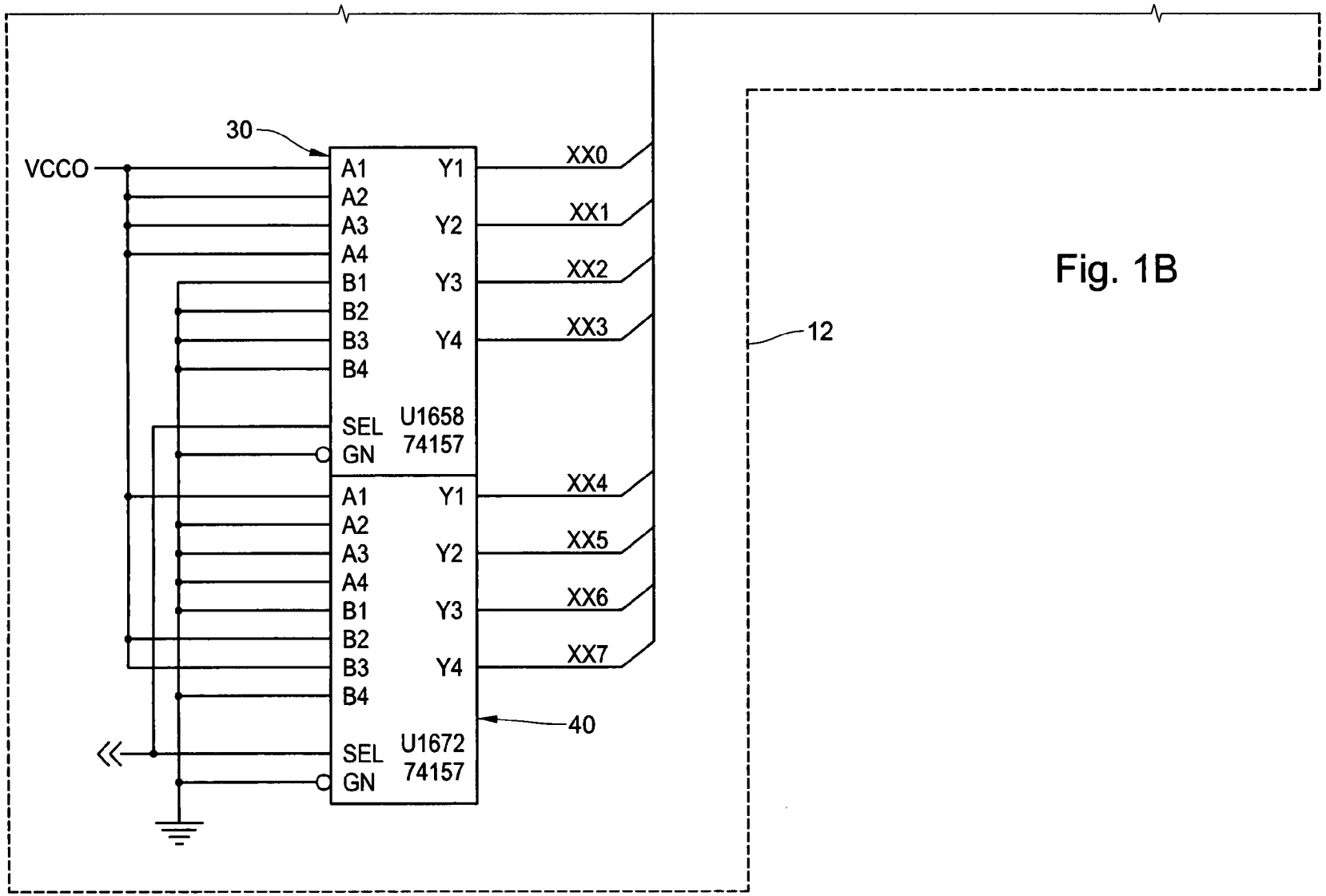

An exemplary embodiment of the system for temporal dithering of an LED indicator for achieving a multi-bit color resolution display of this invention is shown in FIG. 1. Temporal dithering system 10 comprises temporal dithering logic 12, which is operably connected to LED 14. Temporal dithering logic 12 comprises counters 20 and 22, multiplexers 30 and 40 and comparator 50. LED 14 can be any bi-color or tri-color LED as known to those in the art (e.g., a Stanley LED part number NKRG141). Further, LED 14 can be a seven-segment LED. Counters 20 and 22, multiplexers 30 and 40 and comparator 50 can be off-the-shelf solid state digital components as known to those skilled in the art and operable to perform the functions described herein.

The embodiment of the present invention shown in FIG. 1 comprises a bi-color, seven-segment LED (red/green) 14 with temporal dithering logic 12 operable to produce a yellow, green, red, or orange output. Other embodiments of the present invention can comprise tri-color LEDs and/or temporal dithering logic configured to produce any shade of color between red and green (for a bi-color LED), or between red and blue (for a tri-color LED) using the presently known LED types. Dithering logic 12 can be configured to perform such dithering using appropriate multiplexers and comparators and/or with counters capable of counting higher than 255.

In operation, temporal dithering logic 12 of FIG. 1 provides an 8-bit output (AEB0-AEB7) from comparator 50 along a set of inputs to LED 14. This 8-bit input to LED 14 will drive LED 14 at a desired display color, in this case either red or green, switching between the two colors at a rate determined to result in a desired perceived display color at LED 14. In this embodiment, counters 20 and 22 are configured to count from 0 to 255, and then to repeat at a set rate of 460 kHz. This means that for every one of the 460,000 cycles per second, counters 20 and 22 will together count from 0 to 255. Counters 20 and 22 provide their outputs to comparator 50 and to adder 55 as inputs CNT0 to CNT7. Adder 55 uses the counter 20 and 22 outputs to keep a running count, and when the count reaches 256, adder 55 provides a reset signal to counters 20 and 22 to reset counters 20 and 22 back to zero. Comparator 50 also receives inputs XX1 through XX7 from multiplexers 30 and 40.

Multiplexers 30 and 40 are controlled by input signal ILP8. Input signal ILP8 determines the value of outputs XX0 through XX7 to select the desired LED14 display color. Therefore, together with counters 20 and 22, multiplexers 30 and 40 determine the color displayed by LED 14. The value of input signal ILP8 is determined by which color it is desired to display at LED 14. For example, when input signal ILP8 is high in the embodiment of FIG. 1, orange is selected as the perceived display color for LED 14 and the value of outputs XX0 to XX7 is, for example, 96 (out of 255). When input signal ILP8 is low, yellow is selected as the desired LED 14 perceived display color and the value of outputs XX0 to XX7 is, for example, 31 (again, out of 255). The value of input signal ILP8 can be toggled between "High" and "Low", in this embodiment, for example, by a mode switch on a device implementing this embodiment of the method and system of the present invention. Alternatively, signal ILP8's value can be set by an automated process in response to changing conditions, such as an out-of-limit condition on a monitored parameter. In the embodiment of FIG. 1, signal ILP8 is a one-bit signal used to select between two display colors (e.g., red and green) at LED 14. However, it is contemplated that ILP8 can be a multi-bit signal in other embodiments to select from a greater number (e.g., >2) of display colors at LED 14.

Comparator 50 receives inputs XX0 to XX7 and compares them to input signal CNT0 to CNT7. When the 8-bit input CNT0 to CNT7 is equal to the 8-bit input XX0 to XX7, comparator 50 triggers (sets) latch output 57, which changes the displayed color at LED 14 to the next color in the LED 14 color palette determined to result in the desired perceived color at LED 14. The value of input signal ILP8 thus controls the percentage of time during each cycle that a color is displayed at LED 14 as determined to result in the selected perceived color at LED 14. ILP8 can be manually controlled or can be set to be controlled by additional circuitry and/or an algorithm which can detect changing conditions and set the output color of LED 14 as desired.

In the embodiment of FIG. 1, seven-segment bi-color LED 14 is designed to deliver either a green or red color. By selecting, at a high enough frequency, which of red or green color is displayed at LED 14, the perceived output color at LED 14 can be made to vary between the maximum red available to the maximum green available. For example, as configured in FIG. 1, the color red is displayed at LED 14 when the count from counters 20 and 22 equals zero (i.e., the 8-bit output CNT0 to CNT7 is representative of digital number zero). If yellow is the desired perceived output color, then the latch output 57 is set when the value of counter outputs CNT0 to CNT7 equal 31. When CNT0 to CNT7 equal 31, the displayed color at LED 14 is changed from red to green until the counter values CNT0 to CNT7 equal 255. When CNT0 to CNT7 equal 255, adder 55 resets counters 20 and 22 to zero, comparator 50 resets latch output 57, and red is once again the displayed color at LED 14 for the next cycle until the counter 20 and 22 outputs again equal 31.

The higher the value of the multiplexers 30 and 40 outputs XX0 to XX7, the longer the time the color red will be displayed at LED 14 during a particular cycle. The longer the color red is displayed, the closer the perceived color at LED 14 will be to red on the color spectrum. This is because red is displayed at LED 14 until the latch value 57 sets high. The perceived display color at LED 14 can thus be fine-tuned (i.e., different color tones can be selected) based on the setpoint for latch value 57, as determined by the outputs from multiplexers 30 and 40. For example, if the latch value 57 does not set high until the output CNT0 to CNT7 from counters 20 and 22 equals 222, then red will be displayed at LED14 for 222 counts of each cycle and green will only be displayed for 33 counts of each cycle. The latch value 57 is initially set to low, then set high when the counter output CNT0 to CNT7 value is equal to the value of output XX0 to XX7 from multiplexers 30 and 40. Latch value 57 resets low again when the output from counters 20 and 22 is reset to zero at the beginning of the next cycle. Note that in the embodiment of FIG. 1, multiplexers 30 and 40 are each 4-bit multiplexers which together are equivalent to an 8-bit multiplexer for multiplexing the 8-bit output XX0 to XX7. Multiplexers 30 and 40 can be selected to be a different size to match a desired application.

Although the embodiment illustrated in FIG. 1 comprises counters 20 and 22 that count from 0 to 255 (i.e., provide an 8-bit output) at an update rate of 460 kHz, it is contemplated, and should be understood by those familiar with the art, that the method and system of this invention can instead comprise a higher refresh rate and counters capable of higher counts (for greater accuracy in the perceived color at LED 14). Further, the latch value 57 setpoint can be set to trigger at different points in the count to further improve the accuracy of the perceived color at LED 14. Thus, if greater precision is desired, the counters 20 and 22 can be designed to count up to numbers much higher than 255, allowing for a more precise latch value 57 setpoint and, therefore, for a more precise ratio of colors mixing together to create the desired perceived color at LED 14. Thus, although in the embodiment of FIG. 1, counters 20 and 22 are each 4-bit counters behaving together as an equivalent 8-bit counter, an embodiment of this invention could instead comprise three such 4-bit counters, equivalent to a 12-bit counter, for counting from 0 to 4096.

Digital temporal dithering as illustrated in the embodiment of FIG. 1 involves a bi-color seven-segment LED 14, with the displayed color at LED 14 switched between red and green at a preset ratio during each cycle at a cycle rate of 460 kHz. Each of the 460,000 cycles per second has a period $T=1/460{,}000$ second. During each of these 460,000 cycles per second, LED 14 displays a red color for duration "t," and a green color for duration "T-t". The temporal resolution of "t" is "T" divided by 256, as the counters 20 and 22 count from 0 to 255 within each cycle. Hence, 256 different durations of red or green are available per cycle, delivering 256 settings of color (8-bit color). Depending on the respective durations of red and green during each cycle, the perceived color of LED 14 can be made to be different tones of red, orange, yellow, and green.

The semi-conductor gap width (type and doping) and the spectral filtration of an emission placed on top of the gap width determine the color of an LED indicator. Typically, the colors of yellow and green LEDs are too similar to effectively communicate the status of a monitored device parameter. The use of bi-color or tri-color LEDs is similarly limited by the fact that only two or three colors are available. Temporal dithering of bi-color or tri-color LEDs in accordance with the teachings of this invention can provide multi-bit color resolution LED indicators using existing two and/or three-color LED indicators. In the example embodiment of FIG. 1, 256 perceived LED (8-bit) color tones spanning from red through orange and yellow to green are capable using a simple red/green bi-color LED indicator.

Although not shown in FIG. 1, system 10 also comprises a power source, clocks, memory and any other components, as known to those familiar with the art, that may be necessary to make the circuit work as described herein. System 10 can further comprise, among the components not shown in FIG. 1, a processing device to execute the instructions necessary to implement an embodiment of the system and method of the present invention. The processing device can be a microprocessor, a micro-controller, a central processing unit, a field programmable array or programmable logic device, a state machine, logic circuitry, analog circuitry, digital circuitry and/or any device that can manipulate signals based on operational instructions. System 10 can further comprise memory, which can be a single memory device or a plurality of memory devices, and such memory device may be a read only memory (ROM), random access memory (RAM), volatile memory, non-volatile memory, static memory, dynamic memory, flash memory and/or any device that stores digital information.

Figure 2:
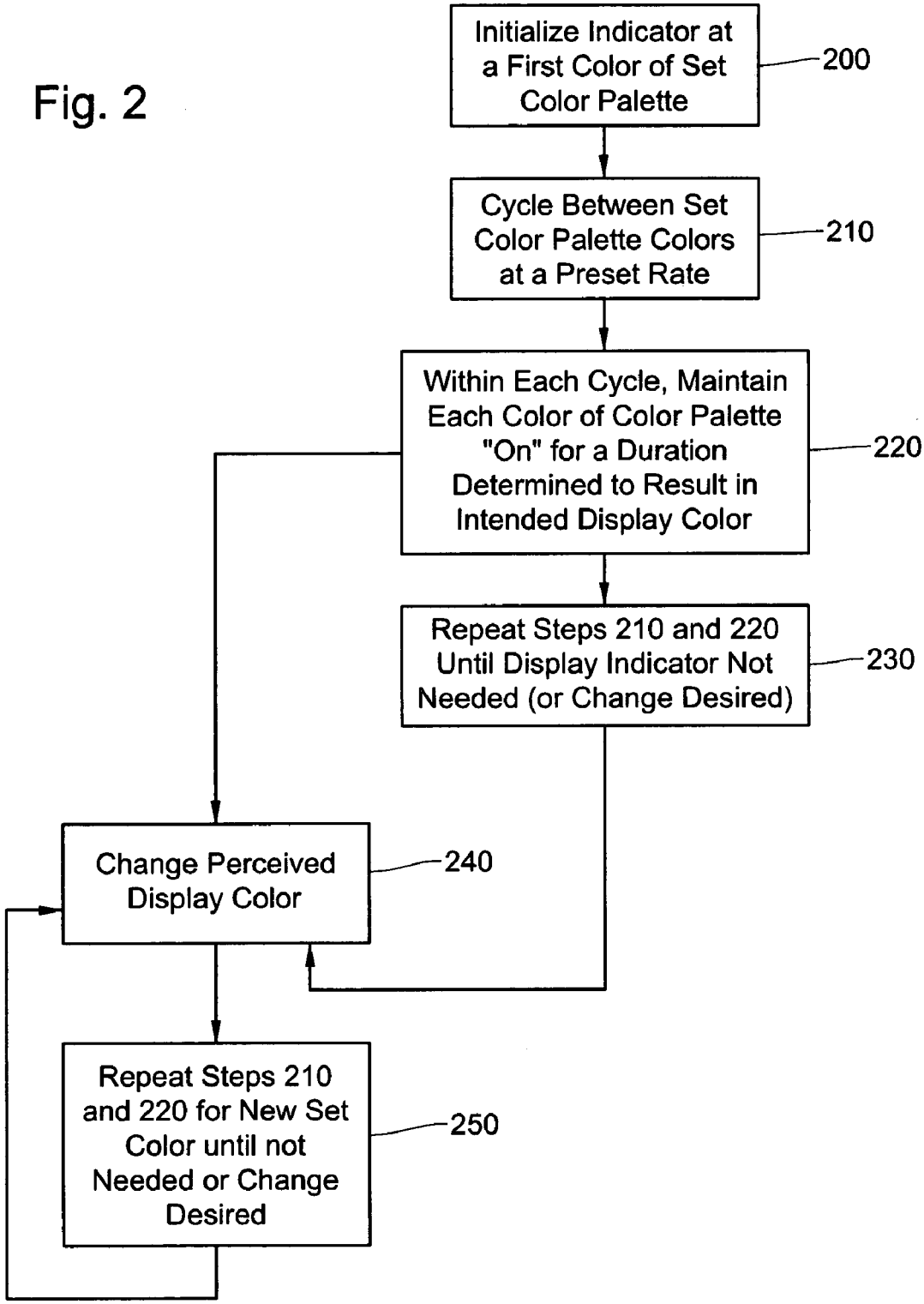
FIG. 2 is a simplified flowchart illustrating one embodiment of the method of this invention.

FIG. 2 is a simplified flow chart illustrating one embodiment of the method for temporal dithering of an LED indicator to achieve a multi-bit color resolution display of the present invention. At step 200, the LED indicator, such as LED 14 of FIG. 1, or indicators, are initialized (power supplied) at a first color of a set color pallet. This could be, for example, the color red of a bi-color red/green LED or the color red of a tri-color red/green/blue LED. The color pallet is the range of discrete colors that the LED is capable of displaying without the temporal dithering taught by the present invention. At step 210, the method of this invention cycles, at a predetermined rate (e.g., 460 kHz), between predetermined on-off sequences for the colors of the set color pallet of the LED indicator, starting with a first color of the color palette. Both the predetermined cycling rate and the predetermined on-off sequences (discussed more fully below) can be arbitrarily set as required for different applications and to improve the quality of the perceived color displayed at LED 14.

At step 220, within each cycle of the predetermined rate of step 210, each color of the color pallet is maintained in an on-state for a duration determined to result in an intended perceived color at LED 14. For example, in a bi-color LED implementation as described with reference to FIG. 1, the red color may be held on for 31 of 256 counts within each cycle, and the green color held on for the remaining 225 cycles, to deliver a perceived yellow color at LED 14 for an observer. Note that the on-time of each discrete color of the color pallet can range anywhere from zero up to the maximum number of time increments set for each cycle, as determined by the counters, such as counters 20 and 22 of FIG. 1, used in an implementation. The counters can be selected to deliver any range of counts and hence provide for greater than 8-bit colors.

From step 220, the method of this invention can continue at either step 240 or step 230. At step 230, steps 210 and 220 are repeated such that the intended perceived display color is displayed at a device implementing an embodiment of the method and system of the present invention until that indicator is no longer needed (for example, the device is turned off or that indication is turned off). Alternatively, the embodiment of the method of this invention illustrated in FIG. 2 can progress to step 240, where the intended perceived display color for an LED 14 can be changed. In other words, at step 240 the duration of the on-state of each discrete color within the set color pallet per each cycle can be either increased or decreased as determined to result in a different perceived display color at LED 14.

The change in the perceived display color of an LED 14 at step 240 can be accomplished either manually (e.g., by an operator changing the parameters of a system implementing this method), or it can be performed via an automated process. For example, if a limit for a parameter linked to a display is exceeded, this embodiment of the method of the present invention can be configured to automatically change, at step 240, the perceived display color to a different color associated with a warning condition. Thus, if the perceived display color is initially yellow, for example, then if a parameter linked to that display exceeds a set limit, the method of this invention at step 240 can be configured to automatically change the perceived display color to red to indicate to an observer that a parameter has been exceeded.

At step 250, the method of this invention repeats steps 210 and 220 for the new perceived color until once again the display indicator is no longer needed. Note that once the condition requiring the change in the perceived display color has passed, (e.g., the parameter is back in spec), then according to the method of the present invention, the perceived display color can be changed back, either automatically or manually by an operator, to the initial perceived display color or to some other color. From both steps 230 and 250, the method of this invention can proceed to step 240 to change the perceived display color, as previously discussed, if required.

Because temporal color dithering is based on human vision properties, there is no real spectral change occurring during the temporal dithering. Thus, temporal dithering should be used only where human vision color perceptions is concerned, for example, for indicators and warning signals. As discussed above, multiple color signals can be communicated from the same LED indicator by using temporal color dithering in accordance with this invention. Thus, a better functionality and broader range of applications for existing LED indicators can be achieved. Temporal dithering of bi- and tri-color LEDs opens up new possibilities of multi-bit color in indicators. Not only can colors that serve better for indicating purposes be achieved, but also complete and new indicator applications can be designed using continuous color variation of indicators. Thus, with the embodiments of the method and system of this invention, the perceived display color at an LED 14 can, for example, be continuously changed from one tone to another. Therefore, embodiments of the method and system of this invention can significantly improve the performance of currently existing LED color indicators.

The embodiments of the method of this invention can be implemented as machine executable software instructions, which can be stored in memory, such as a memory 404 as described with reference to FIG. 4. Embodiments of the system of this invention can comprise a memory, such as memory 404, storing machine executable software instructions for implementing one or more embodiments of the method of this invention. Such a system can further comprise a processing module, such as processing module 402 of FIG. 4, for implementing the software instructions stored in memory.

FIG. 3 is a simplified block diagram showing examples of the various applications that could benefit from implementing an embodiment of the method and system of the present invention. A multi-color LED 300 in accordance with the teachings of this invention can, for example, be used to provide an indication of a parameter, or an indication of a warning condition, on a surgical console 310, or to display one or more parameters on a stereo 320, on an auto dash 340 within a car 350, to indicate channel, volume or other parameters on a TV 330, or other consumer devices, or even to indicate a numeric or other parameter on a hand held device 360, which could be, for example, a cordless telephone. As will be obvious to those of average skill in the art, the applications for multi-color, multi-bit LED color displays in accordance with the teachings of this invention are varied and numerous. It is contemplated that all such uses are within the spirit and the scope of the present invention.

A further embodiment of the present invention can comprise an apparatus for temporal dithering of an LED indicator to achieve a multi-bit color resolution display. As shown in FIG. 4, the apparatus 400 can comprise a processing module 402 and a memory 404. Processing module 402 may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that can manipulate signals based on operational instructions. The memory 404 may be a single memory device or a plurality of memory devices. Such a memory device may be a read only memory, random access memory, volatile memory, non-volatile memory, static memory, dynamic memory, flash memory, and/or any device that can store digital information. Note that when processing module 402 implements one or more of its functions via a state machine, analog circuitry, digital circuitry, and/or logic circuitry, the memory storing the corresponding operational instructions is embedded with the circuitry comprising the state machine, analog circuitry, digital circuitry, and/or logic circuitry. The memory 404 stores, and the processing module 402 executes, operational instructions corresponding to at least some of the steps and/or functions illustrated in FIGS. 1-3.

In a particular embodiment of apparatus 400, the memory 404 is operably coupled to processing module 402 and includes operational instructions that cause the processing module 402 to: initialize an LED indicator to display a first color of a color palette; during each cycle of a preset cycling rate, cycle the LED indicator display color between the first color and one or more selected colors of the color palette, wherein the LED indicator is caused to display in turn the first color and each selected color of the color palette for a preset portion of each cycle determined to result in a perceived display color at the LED indicator; and repeat the cycling step to maintain the perceived display color at the LED indicator.

The operational instructions can further comprise operational instructions that cause the processing module to change the perceived display color to a new perceived display color, wherein changing the perceived display color comprises: adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator.

Although the present invention has been described in detail herein with reference to the illustrated embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the sprit and true scope of this invention as claimed below. Thus, while the present invention has been described in particular reference to the general area of 8-bit color LED indicators, the teachings contained herein apply equally wherever it is desirous to provide multi-bit, multi-color LED indicators and warning signals.

What is claimed is:

1. A method for temporal dithering of a light emitting diode ("LED") indicator, comprising the steps of:

initializing the LED indicator to display a first color of a color palette;

during each cycle of a preset cycling rate, cycling the LED indicator display color between the first color and one or more selected colors of the color palette, wherein the LED indicator is caused to display in turn the first color and each selected color of the color palette for a preset portion of each cycle determined to result in a perceived display color at the LED indicator; and repeating the cycling step to maintain the perceived display color at the LED indicator.

2. The method of claim 1, wherein the LED indicator is a bi-color LED indicator and wherein the color palette comprises a red color and a green color.

3. The method of claim 1, wherein the LED indicator is a tri-color LED indicator and wherein the color palette comprises a red color, a green color and a blue color.

4. The method of claim 1, wherein the preset cycling rate is selected to result in the perceived display color selected by the cycling of the LED indicator display color.

5. The method of claim 4, wherein the preset cycling rate is 460 kHz.

6. The method of claim 1, wherein each cycle of the preset cycling rate comprises a number of equal discrete time periods set by selection of a counter, wherein the number of equal discrete time periods is equal to the range of the counter.

7. The method of claim 6, wherein each preset portion of each cycle during which the first color and each of the one or more selected colors is displayed comprises one or more of the equal discrete time periods, and wherein the size of the preset portion for each of the first color and the one or more selected colors is set to result in a perceived display color at the LED indicator.

8. The method of claim 7, wherein each displayed color can have a different size preset portion of each cycle during which it is displayed at the LED indicator.

9. The method of claim 8, wherein the sum of the preset portions for all displayed colors is equal to the number of equal discrete time periods.

10. The method of claim 1, wherein the first color can be any color of the color palette, and wherein the color palette includes no color displayed at the LED indicator.

11. The method of claim 1, wherein the perceived display color is the blended sum of the first and the one or more selected colors displayed at the LED indicator as perceived by a human observer.

12. The method of claim 1, wherein the perceived display color lies on the color spectrum between the lowest frequency and the highest frequency colors in the color palette.

13. The method of claim 1, wherein the LED indicator is a seven-segment LED indicator.

14. The method of claim 1, further comprising the step of changing the perceived display color to a new perceived display color, wherein changing the perceived display color comprises:

adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator.

15. The method of claim 14, wherein the step of changing the perceived display color is manually initiated.

16. The method of claim 14, wherein the step of changing the perceived display color is automatically initiated in response to a changing condition.

17. The method of claim 16, wherein the changing condition is an exceeded limit of a parameter associated with the LED indicator.

18. A system for temporal dithering of an indicator, comprising:

a light emitting diode ("LED") indicator operable to display a light color;

a temporal dithering logic operable to drive the LED; and an algorithm operable to control the temporal dithering logic and cause the LED indicator to sequentially display one or more light colors from a color palette associated with the LED indicator in a pattern determined to result in a perceived display color at the LED indicator, wherein the algorithm comprises computer-executable software instructions operable to control the temporal dithering logic, and wherein sequentially displaying the one or more light colors from a color palette at the LED indicator comprises:

initializing the LED indicator to display a first light color of the color palette;

during each cycle of a preset cycling rate, cycling the LED indicator display color between the first color and one or more selected colors of the color palette, wherein the LED indicator is caused to display in turn the first color and each selected color of the color palette for a preset portion of each cycle determined to result in a perceived display color at the LED indicator; and repeating the cycling step to maintain the perceived display color at the LED indicator.

19. The system of claim 18, wherein the preset cycling rate is selected to result in the perceived display color selected by the cycling of the LED indicator display color.

20. The system of claim 19, wherein the preset cycling rate is 460 kHz.

21. The system of claim 18, wherein each cycle of the preset cycling rate comprises a number of equal discrete time periods set by selection of a counter, wherein the number of equal discrete time periods is equal to the range of the counter.

22. The system of claim 21, wherein each preset portion of each cycle during which the first color and each of the one or more selected colors is displayed comprises one or more of the equal discrete time periods, and wherein the size of the preset portion for each of the first color and the one or more selected colors is set to result in a perceived display color at the LED indicator.

23. The system of claim 22, wherein each displayed color can have a different size preset portion of each cycle during which it is displayed at the LED indicator.

24. The system of claim 23, wherein the sum of the preset portions for all displayed colors is equal to the number of equal discrete time periods.

25. The system of claim 18, wherein the first color can be any color of the color palette, and wherein the color palette includes no color displayed at the LED indicator.

26. The system of claim 18, wherein the perceived display color is the blended sum of the first and the one or more selected colors displayed at the LED indicator as perceived by a human observer.

27. The system of claim 18, wherein the algorithm further comprises computer-executable software instructions operable to change the perceived display color to a new perceived display color, wherein changing the perceived display color comprises:

adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator.

28. The system of claim 27, wherein the step of changing the perceived display color is manually initiated.

29. The system of claim 27, wherein the step of changing the perceived display color is automatically initiated in response to a changing condition.

30. The system of claim 29, wherein the changing condition is an exceeded limit of a parameter associated with the LED indicator.

31. The system of claim 18, wherein the temporal dithering logic comprises:

a counter, operable to produce a counter output signal;

a multiplexer, operable to produce a multiplexer output signal for selecting from the color palette the light color displayed at the LED indicator;

an adder operable to receive the counter output signal and to reset the counter when the counter output signal reaches a maximum value; and a comparator operable to: receive and compare the counter output signal and the multiplexer output signal; provide a driving signal to the LED indicator to cause the LED indicator to display the selected light color as determined by the multiplexer output signal; and if the counter output signal and the multiplexer output signal are of equal value, produce a latch signal to cause the driving signal value to change to select a next light color from the color palette for display at the LED indicator.

32. The system of claim 31, wherein the counter is an 8-bit counter.

33. The system of claim 31, wherein the counter comprises two or more counters communicatively connected and operable to provide a multi-bit output.

34. The system of claim 31, wherein the multiplexer is an 8 bit-multiplexer.

35. The system of claim 31, wherein the multiplexer comprises two or more multiplexers communicatively connected and operable to provide a multi-bit output.

36. The system of claim 31, wherein the driving signal from the comparator to the LED indicator is an 8-bit signal.

37. The system of claim 31, wherein the counter maximum value is the highest digital value the counter is capable of counting.

38. An apparatus for temporal dithering of a light emitting diode ("LED") indicator, the apparatus comprising:

a processing module; and a memory operably coupled to the processing module, wherein the memory includes operational instructions that cause the processing module to:

initialize the LED indicator to display a first color of a color palette;

during each cycle of a preset cycling rate, cycle the LED indicator display color between the first color and one or more selected colors of the color palette, wherein the LED indicator is caused to display in turn the first color and each selected color of the color palette for a preset portion of each cycle determined to result in a perceived display color at the LED indicator; and repeat the cycling step to maintain the perceived display color at the LED indicator.

39. The apparatus of claim 38, wherein the LED indicator is a bi-color LED indicator and wherein the color palette comprises a red color and a green color.

40. The apparatus of claim 38, wherein the LED indicator is a tn-color LED indicator and wherein the color palette comprises a red color, a green color and a blue color.

41. The apparatus of claim 38, wherein the preset cycling rate is selected to result in the perceived display color selected by the cycling of the LED indicator display color.

42. The apparatus of claim 41, wherein the preset cycling rate is 460 kHz.

43. The apparatus of claim 38, wherein each cycle of the preset cycling rate comprises a number of equal discrete time periods set by selection of a counter, wherein the number of equal discrete time periods is equal to the range of the counter.

44. The apparatus of claim 43, wherein each preset portion of each cycle during which the first color and each of the one or more selected colors is displayed comprises one or more of the equal discrete time periods, and wherein the size of the preset portion for each of the first color and the one or more selected colors is set to result in a perceived display color at the LED indicator.

45. The apparatus of claim 44, wherein each displayed color can have a different size preset portion of each cycle during which it is displayed at the LED indicator.

46. The apparatus of claim 45, wherein the sum of the preset portions for all displayed colors is equal to the number of equal discrete time periods.

47. The apparatus of claim 38, wherein the first color can be any color of the color palette, and wherein the color palette includes no color displayed at the LED indicator.

48. The apparatus of claim 38, wherein the perceived display color is the blended sum of the first and the one or more selected colors displayed at the LED indicator as perceived by a human observer.

49. The apparatus of claim 38, wherein the perceived display color lies on the color spectrum between the lowest frequency and the highest frequency colors in the color palette.

50. The apparatus of claim 38, wherein the operational instructions further comprise operational instructions that cause the processing module to change the perceived display color to a new perceived display color, wherein changing the perceived display color comprises:

adjusting the size of the preset portion of each cycle allotted to each of the first color and the one or more selected colors for display, wherein the size of each preset portion is determined to result in the new perceived display color; and repeating the cycling step using the adjusted preset portion sizes to maintain the new perceived display color at the LED indicator.

51. The apparatus of claim 50, changing the perceived display color is automatically initiated in response to a changing condition.

52. The apparatus of claim 51, wherein the changing condition is an exceeded limit of a parameter associated with the LED indicator.

* * * * *